United States Patent [19]

Coeurderoy

[11] 3,963,039

[45] June 15, 1976

[54] HYDRAULIC INSTALLATION WITH MEANS FOR STORING ENERGY

[75] Inventor: Yves G. Coeurderoy, Lagney-Le-Sec, France

[73] Assignee: Societe Anonyme: Poclain, Belleville, France

[22] Filed: Jan. 14, 1975

[21] Appl. No.: 540,966

[30] Foreign Application Priority Data

Jan. 24, 1974 France ..... 74.02411

[52] U.S. Cl. ..... 137/118; 60/413

[51] Int. Cl.[2] ..... F15B 15/00

[58] Field of Search ..... 137/118, 119, 608, 596, 137/596.14; 91/29, 6; 60/413, 418

[56] References Cited

UNITED STATES PATENTS

| | | | |
|---|---|---|---|
| 2,656,848 | 10/1953 | Noon et al. | 137/118 |
| 2,799,996 | 7/1957 | VanMeter | 137/118 X |
| 2,850,878 | 9/1958 | Sampietro et al. | 60/418 |
| 3,016,710 | 1/1962 | Kurz et al. | 60/413 X |
| 3,283,165 | 11/1966 | Bloch | 60/413 X |
| 3,426,647 | 2/1969 | Martin et al. | 13/596 X |

*Primary Examiner*—Martin P. Schwadron
*Assistant Examiner*—Robert J. Miller
*Attorney, Agent, or Firm*—Lewis H. Eslinger; Alvin Sinderbrand

[57] ABSTRACT

A hydraulic installation with means for storing energy produced by the prime mover during a rest period of the installation. Energy is stored by a fluid accumulator by suitable positioning of control valves during the reset period. Control of the valves is effected by a logic circuit responsive to pressure in the accumulator, pressure in the main feed conduit leading to the driven device, and the position of a feed conduit control valve.

4 Claims, 1 Drawing Figure

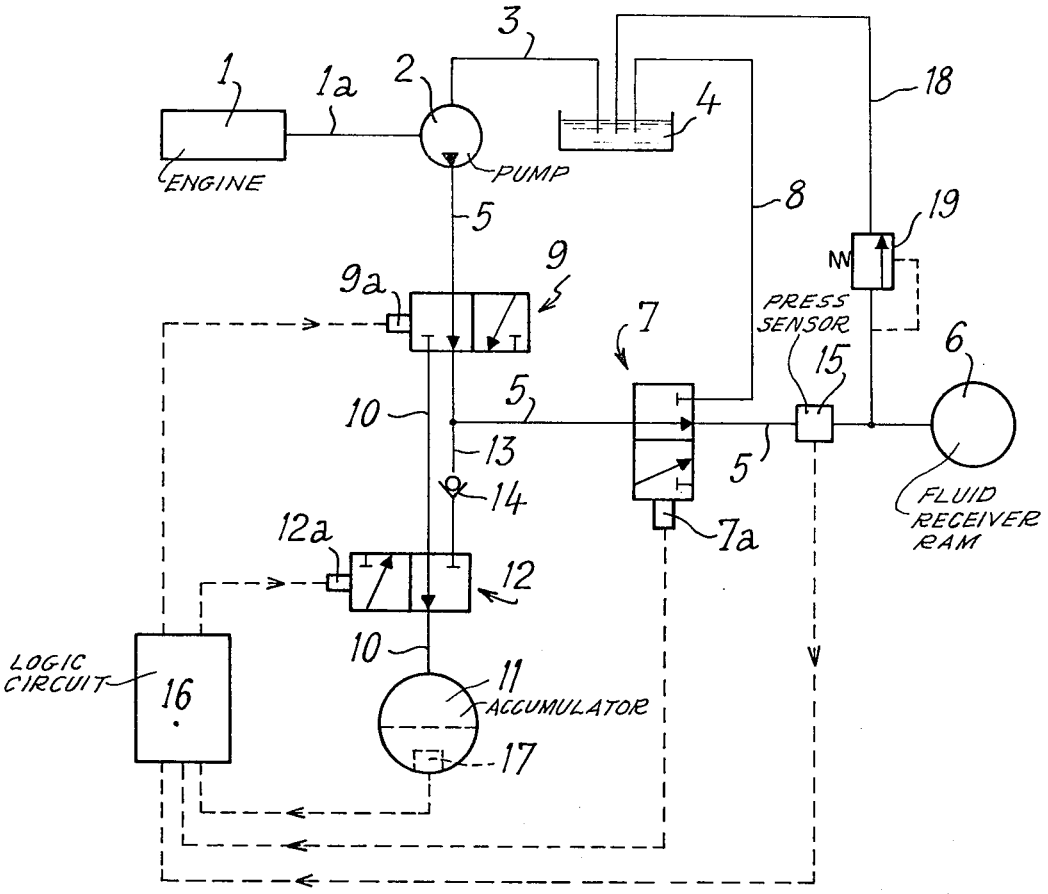
1
1a
2
3
4
18
ENGINE
PUMP
5
8
19
9
9a
7
PRESS SENSOR
15
6
10
5
13
14
5
7a
FLUID RECEIVER RAM
12a
12
10
LOGIC CIRCUIT
16
11
ACCUMULATOR
17

HYDRAULIC INSTALLATION WITH MEANS FOR STORING ENERGY

The present invention relates to a hydraulic installation including arrangements enabling energy to be accumulated in the form of a fluid stored under pressure.

The hydraulic installation of a Public Work machine experiences because of the nature of the jobs performed by the machine "dead" operational periods. For example, a dead period exists when a machine is awaiting the positioning of a transport vehicle which is to receive its load. In general terms the machine will experience a dead period when, for reasons of synchronization of jobs on a site, it is in a waiting or rest phase.

The aim of the invention is to employ all of part of the power output of the machine prime mover which is not being used during these dead periods by storing it for use when the machine is working at full load. The result is a better overall profitability of the machine and improvement in its maximum performance since at that time there is available a surplus of power.

According to the present invention there is provided a hydraulic installation comprising: at least one pump capable of delivering a fluid under pressure through a delivery pipe towards either of a receiver member or a fluid tank depending upon the position of a first regulator; a second regulator in the delivery pipe between the pump and the said first regulator, said second regulator being capable of establishing, in a first position, communication between the pump and a first set of auxiliary pipework terminating in a accumulator of fluid under pressure and interrupting the said delivery pipe, and in a second position, the opening the said delivery pipe and the interruption of the aforesaid communication; the said first set of auxiliary pipework including a third regulator capable of establishing, in a first position, communication between the accumulator and a second set of auxiliary pipework terminating in the delivery pipe between the first regulator and the second regulator whilst interrupting the said first set of pipework and in a second position, the opening of the first set of pipework and the isolation of the accumulator from the second set of auxiliary pipework; a pick-up for emitting a signal indicative of the position of the first regulator; a pressure-pick-up for emitting a signal indicative of the pressure in the accumulator; and a logic system responsive to said signal indicative of the position of the first regulator and to said signal indicative of the pressure in the accumulator for controlling the positions of the second and third regulators.

The invention will be better understood from the following description of a preferred embodiment thereof, given by way of example only, reference being had to the attached drawing which shows diagrammatically an embodiment of hydraulic installation in accordance with the invention.

Referring to the drawing there is seen an engine 1 having an output shaft 1*a* which is keyed in rotation a pump 2. This pump 2 is connected by a suction pipe 3 to a fluid tank 4 and is capable of feeding into a delivery pipe 5 in the direction either of receiver members 6 or the tank 4. A regulator 7, called a use-regulator mounted, is in delivery pipe 5 and establishes selectively the opening of this pipe in the direction of the members 6 and communication between this pipe and a return pipe 8 to the tank 4. This regulator 7 is controlled either manually or automatically as a function of the conditions of use of the installation.

A second two-way two-position regulator 9 is arranged in the pipe 5 between the pump 2 and the regulator 7. In its first position it establishes communication between the pipe 5 and a first set of auxiliary pipework 10, thus preventing fluid flow in pipe 5 beyond the regulator 7. In its second position it establishes the opening of the pipe 5 while isolating and shutting off that pipe from fluid flow pipe 10.

The auxiliary pipework 10 terminates in an accumulator of fluid under pressure 11. It includes between the regulator 9 and the accumulator 11 a third two-way two-position regulator 12. In its first position this regulator 12 establishes communication between the accumulator 11 and a second set of auxiliary pipework 13 while closing off the pipework 10. The said pipework 13 branches off the pipe 5 between the regulator 9 and the regulator 7. In its second position the regulator 12 establishes the opening of the pipework 10 while isolating from the accumulator 11, the pipework 13. This pipework 13 is equipped with a non-return valve 14 allowing only one direction of flow of the fluid in the pipework, that is to say, that going from the accumulator 11 towards the pipe 5.

There will be observed in addition the presence of a position pick-up 7*a* on the regulator 7. This pick-up is capable of emitting a signal indicative of one or other of the positions adopted at the will of the driver of the machine by the regulator 7, in the direction of one of the inputs to a logic system 16. A second input to this system 16 is connected to a pressure pick-up 17 housed in the accumulator 11. Finally a third input is connected to a pressure pick-up 15 arranged in the portion of the pipe 5 which lies between the regulator 7 and the receiver members 6. This pick-up 15 is capable of emitting a signal in the direction of the system 16, representative of the value of the fluid pressure picked up from the pipe 5.

The two outputs from the logic system 16 are respectively connected to the pilot members 9*a* and 12*a* of the regulators 9 and 12.

It is to be observed finally in this FIGURE that safety pipework 18 connects the final portion of the pipe 5 to the fluid tank 4. This pipework carried a relief-valve 19 calibrated at a predetermined value.

The method of operation explained below for this installation in accordance with the invention will enable its main advantages to be displayed. Assuming the engine 1 is running, the pump 2 delivers fluid under pressure into the pipe 5. Let the regulator 9 likewise be assumed to be in its second position aforesaid, that is to say, that shown in the drawing. The regulator 7 can direct the fluid delivered into the pipe 5, either towards the receiver members 6 in the position as the FIGURE, or towards the tank 4 via the pipe 8 if it is in its other position. The machine upon which is mounted the installation of the invention being assumed to be in a waiting phase, the fluid is returned through the regulator 7 to the tank 4.

The position-pick-up 7*a* therefore detects a position of the regulator 7 corresponding with zero delivery into the receiver members 6 and emits a signal corresponding with this state to the logic system 16. The latter emits at its output a first signal in the direction of the pilot member 9*a* on the regulator 9 so that the latter takes up and retains its first position, that is to say, that establishing communication between the pump 2 and the auxiliary pipework 10. The system 16 simultaneously emits a signal in the direction of the pilot member 12*a* on the regulator 12 so that the latter takes up and retains its second position, that is to say, that opening the pipework 10. It is therefore seen that the fluid delivered by the pump 2 is then sent via the pipework 10 into the accumulator 11.

Assuming that the waiting phase to which the machine is subjected is sufficiently long the accumulator 11 fills completely and the fluid which it contains is at its maximum pressure. There is therefore storage of energy in the form of a compressed fluid. This pressure is therefore detected by the pick-up 17 which emits a signal in the direction of the logic system 16. This system emits at its output a signal in the direction of the regulator 9 to make it rock into its second position. The fluid delivered by the pump 2 is then returned to the tank 4 via the pipe 5, the regulator 7 and the pipe 8 if the machine is still in the waiting phase. The regulator 12 remains in its second position.

Assume now that from some reason or other the driver puts an end to the waiting phase of the machine by acting on the regulator 7. The state of the hydraulic installation at the instant of interruption of the waiting phase depends upon the time for which has lasted.

If this time is shorter than that necessary to the filling of the accumulator 11 the position-pick-up 7*a* emits a signal such that at its output the logic system controls the regulator 9 by means of its member 9*a* so that it takes up and retains its second position, that is to say, that in which it opens the pipe 5. The fluid delivered by the pump 2 can then reach the receiver members 6. Simultaneously with this control action the system 16 controls the regulator 12 by its member 12*a* so that it takes up and retains its first position, that is to say, that establishing communication between the accumulator 11 and the auxiliary pipework 13. At this stage either the pressure obtaining in the accumulator 11 is greater than that of the fluid flowing through the pipe 5 and there is a flow of fluid from the accumulator towards the pipe 5 through the non-return valve 14 carried by the pipework 13, or the pressure in the accumulator 11 is lower than that of the fluid in the pipe 5 and there is no restoration of fluid.

If on the contrary the time during which the machine has been in the waiting phase is longer than that necessary to the filling of the accumulator 11 the latter is completely full and the installation is in the state explained by the first assumption above. Rocking of the regulator 7 into its position opening the pipe 5 brings about the emission of a signal by the pick-up 7*a* which interpreted by the logic system 16, leads to the regulator 12 moving from its second position to its first. There is therefore restoration by the accumulator 11 of the fluid which it contains towards the use-circuit 5.

It must however be observed that this restoration can only be effected if the pressure obtaining in the pipe 5 is lower than the calibration value expressed in units of pressure, of the relief-valve 19.

That is, let it be assumed that the receiver 6 is a mechanical shovel beam and that in a working phase the bucket stops against an obstacle. The pressure in the pipe 5 will rise up to the calibration value of the relief-valve 19 beyond which is injurious to the installation. thus for a certain length of time the bucket will be caught against the obstacle and the fluid delivered by the pump 2 will make its way back to the tank through the valve 19. It would therefore be advantageous if the accumulator 11 did not restore its fluid which would likewise escape through the valve 19. It must be observed in this connection that the maximum pressure of the fluid contained in the accumulator 11 is on the one hand adjustable and on the other hand higher than the said calibration value in order that there may be the possibility of restoration when the machine is working in a pressure range close to this value. This advantageous arrangement is achieved by means of the pressure-pick-up 15 which emits a signal indicative of the value of the pressure in the pipe 5. When this pressure is equal to the aforesaid calibration value the signal is interpreted by the system 16 which controls the regulator 12 by its piloting member 12*a* so that whatever its previous position was it takes up and/or retains its second position, that is to say the one which interrupts the connection between the accumulator 11 and the pipe 5.

Finally in this method of operation it will be observed that the non-return valve 14 prevents filling of the emptied accumulator through the pipe 13 and hence prevents parasitical use of the energy supplied to the pump 2 during a working phase.

When the machine returns to a waiting phase the cycle of accumulation-restoration will evolve as described above as a function of the length of the dead period.

The installation in accordance with the invention enables, therefore, storage of energy during working phases which do not employ the whole of the power installed in the machine. It likewise enables this energy to be restored during working phases at full power, thus increasing for a certain length of time — that during which the accumulator 11 empties — the performance of the machine and this without major transformation of the machine. It offers finally the advantage of making profitable the machine upon which it is installed, in an optimum manner.

It offers special interest in the domain of Public Works machines.

It is not limited to the description of it which has just been given but on the contrary covers any variants which might be applied to it without departing from its scope or spirit.

What is claimed is:

1. A hydraulic installation comprising: at least one pump means for delivering a fluid under pressure through a delivery pipe; a first selectively operable regulator means operatively connected to said delivery pipe for selectively supplying fluid under pressure to a receiver member or a fluid tank; second regulator means operatively connected to said delivery pipe, between said pump means and said first regulator means for establishing, in a first position, communication between the pump means and a first set of auxiliary pipework, including an accumulator of fluid under pressure while preventing fluid flow in said delivery pipe beyond the second regulator means, and in a second position, communication between the said delivery pipe and said first regulator means while preventing fluid flow from the delivery pipe to said first set of auxiliary pipework; said first set of auxiliary pipework including third regulator means for establishing, in a first position, communication between the accumulator and a second set of auxiliary pipework, connected to the delivery pipe between the first and second regulator means while preventing fluid flow from said delivery pipe to said first set of auxiliary pipework and, in a second position, communication between said delivery pipe and said first set of pipework while preventing fluid flow from the accumulator to the second set of auxiliary pipework; pick-up means for emitting a signal indicative of the position of the first regulator means; a pressure-pick-up means for emitting a signal indicative of the pressure in the accumulator; and logic means responsive to said signal indicative of the position of the first regulator and to said signal indicative of the pressure in the accumulator, for controlling the positions of the second and third regulators.

2. A hydraulic installation as in claim 1, including at least one set of safety pipework connecting the portion of the delivery pipe between the first regulator means and the receiver member to the fluid tank; a relief valve mounted in said safety pipework and calibrated to a predetermined pressure value; a second pressure-pick-up means for emitting a signal indicative or the pressure between the first regulator and the receiver member; said logic means being responsive to said signal indicative of the pressure between the first regulator means and the receiver member for controlling the position of the third regulator means.

3. An installation as in claim 1 wherein the second set of auxiliary pipework includes a non-return valve means for selectively allowing flow of fluid in the direction from the accumulator towards the delivery pipe.

4. A hydraulic system comprising, a fluid receiver member, pump means for delivering fluid under pressure to said receiver member, a delivery pipe operatively connected between said pump and said receiver member, a fluid reservoir, conduit means for connecting said delivery pipe to said fluid reservoir; a first two-position regulator valve connected to said delivery pipe including means for selectively directing pressurized fluid from said pump means to said receiver member and reservoir; means for accumulating fluid under pressure; first auxiliary conduit means for connecting said delivery pipe to said accumulator means, a two-section second regulator valve operatively connected to said delivery pipe, between said pump means and said first regulator means, and including means for establishing in a first position of said second regulator valve, communication between said pump means and said first auxiliary conduit means while simultaneously preventing fluid flow beyond said second regulator valve in said delivery pipe and, in a second position, establishing communication between said delivery pipe and said first regulator valve while preventing fluid flow from the delivery pipe through said first auxiliary conduit means to said accumulator means; a third two-position regulator valve operatively connected to said first auxiliary conduit means and including means for establishing, in a first position, communication between said accumulator means and said delivery pipe between said first and second regulator valves while preventing fluid flow through said first auxiliary conduit means to said accumulator means and, in a second position, establishing communication between said delivery pipe, through said first auxiliary conduit means, and said accumulator means while preventing fluid flow from the accumulator means to said delivery pipe; pick up means for detecting the position of said first regulator valve and producing a signal indicative of the detected position; pressure pick-up means for detecting the pressure in said accumulator means and producing a signal indicative of the detected pressure; and logic means responsive to said pick up means for controlling the positions of the second and third regulator valves by placing said second regulator valve in its first position and said third regulator valve in its second position when the first regulator valve is positioned to supply fluid to said reservoir and the pressure in said accumulator means is less than a predetermined value and returning said second regulator valve to its second position when the pressure in said accumulator means reaches said predetermined value; said logic means placing said second regulator valve in its second position and said third regulator valve in its first position when said first regulator valve is positioned to supply fluid to said receiver member.

* * * * *